US006566976B2

(12) United States Patent
Krishmar-Junker et al.

(10) Patent No.: US 6,566,976 B2
(45) Date of Patent: May 20, 2003

(54) SYMMETRIC ORTHOMODE COUPLER FOR CELLULAR APPLICATION

(75) Inventors: Gregory P. Krishmar-Junker, Redondo Beach, CA (US); Vrage Minassian, Burbank, CA (US)

(73) Assignee: Northrop Grumman Corporation, Redondo Beach, CA (US)

( * ) Notice: Subject to any disclaimer, the term of this patent is extended or adjusted under 35 U.S.C. 154(b) by 38 days.

(21) Appl. No.: 09/879,610

(22) Filed: Jun. 12, 2001

(65) Prior Publication Data

US 2002/0187760 A1 Dec. 12, 2002

(51) Int. Cl.[7] ..... H01P 1/161; H01P 5/12
(52) U.S. Cl. ..... 333/125; 333/137
(58) Field of Search ..... 333/125, 137, 333/21 A, 21 R, 135, 126

(56) References Cited

U.S. PATENT DOCUMENTS 3,112,460 A * 11/1963 Miller ..... 333/110
3,978,434 A * 8/1976 Morz et al. ..... 333/135
4,047,128 A * 9/1977 Morz ..... 333/122
4,510,469 A * 4/1985 Bowman ..... 333/21 R
5,387,884 A * 2/1995 Porcello ..... 333/33
6,313,714 B1 * 11/2001 Junker et al. ..... 333/125

* cited by examiner

*Primary Examiner*—Robert Pascal
*Assistant Examiner*—Dean Takaoka
(74) *Attorney, Agent, or Firm*—Harness, Dickey & Pierce, P.L.C.

(57) ABSTRACT

An orthomode coupler (10) for directing both satellite uplink and downlink signals. The coupler (10) includes a waveguide structure (14) having a first cylindrical section (28), a conical section (30) and a second cylindrical section (34) providing a waveguide chamber (22) therein. The conical section (30) provides impedance matching of the downlink signal between the waveguide structure (14) and a plurality of symmetrically disposed downlink waveguides (38–44). The waveguides (38–44) are positioned around the waveguide structure (14) and are in signal communication with the waveguide chamber (22) through openings in the tapered section (30). Irises (46–52) are provided at the connection between the downlink waveguides (38–44) and the waveguide chamber (22) for impedance matching purposes.

14 Claims, 2 Drawing Sheets

SYMMETRIC ORTHOMODE COUPLER FOR CELLULAR APPLICATION

CROSS-REFERENCE TO RELATED APPLICATIONS

This application is related to U.S. patent application Ser. No. 09/494,612, filed Jan. 31, 2000, entitled "Wideband TE11 Mode Coaxial Turnstile Junction," and assigned to the Assignee of this application.

BACKGROUND OF THE INVENTION

1. Field of the Invention

This invention relates generally to an orthomode coupler for a cellular communications system and, more particularly, to a tapered orthomode coupler for a cellular communications system that allows for dual sense polarization for both transmission and reception frequency bands.

2. Discussion of the Related Art

Various communications systems, such as certain cellular telephone systems, cable television systems, internet systems, military communications systems, etc., make use of satellites orbiting the Earth to transfer signals. A satellite uplink communications signal is transmitted to the satellite from one or more ground stations, and then retransmitted by the satellite to another satellite or to the Earth as a downlink communications signal to cover a desirable reception area depending on the particular use. The uplink and downlink signals are typically transmitted at different frequency bandwidths. For example, the uplink communications signal may be transmitted at 30 GHz and the downlink communications signal may be transmitted at 20 GHz.

The satellite is equipped with an antenna system including a configuration of antenna feeds that receive the uplink signals and transmit the downlink signals to the Earth. Typically, the antenna system includes one or more arrays of feed horns, where each feed horn array includes an antenna reflector for collecting and directing the signals. In order to reduce weight and conserve satellite real estate, some satellite communications systems use the same antenna system and array of feed horns to receive the uplink signals and transmit the downlink signals. Combining satellite uplink signal reception and downlink signal transmission functions for a particular coverage area using a reflector antenna system requires specialized feed systems capable of supporting dual frequencies and providing dual polarization, and thus requires specialized feed system components. Also, the downlink signal, transmitted at high power (60–100 W) at the downlink bandwidth (18.3 GHz–20.2 GHz), requires low losses due to the cost/efficiency of generating the power and heat when losses are present.

These specialized feed system components include signal orthomode couplers, such as coaxial turnstile junctions, known to those skilled in the art, in combination with each feed horn to provide signal combining and isolation to separate the uplink and downlink signals. The current orthomode couplers are limited in their ability to provide suitable impedance matching between the downlink waveguide and the orthomode coupler over the complete downlink frequency bandwidth. Thus, there is a need in the art to provide a orthomode coupler that has better impedance matching between the orthomode coupler and the downlink waveguides. It is therefore an object of the present invention to provide an improved orthomode coupler having better impedance matching.

U.S. Patent application Ser. No. '162, referenced above, discloses a coaxial turnstile junction for both satellite uplink and downlink signals that provides increased impedance matching between the downlink waveguide and the junction over the complete downlink frequency bandwidth. This junction has been effective for providing signal isolation by using coaxial waveguide chambers to isolate the uplink and downlink signals. However, other satellite applications require combining uplink and downlink signals that employ feed horns not based on coaxial signal separation. The invention satisfies that need.

SUMMARY OF THE INVENTION

In accordance with the teachings of the present invention, an orthomode coupler is disclosed for isolating and directing both satellite uplink and downlink signal, that provides for dual sense polarization. The coupler includes a first end that is in signal communication with an antenna feed horn. The coupler also includes a cylindrical outer wall defining a waveguide chamber that includes a first cylindrical section, a tapered section and a second cylindrical section. A plurality of symmetrically disposed downlink waveguides are positioned around the tapered section and are in signal communication with the waveguide chamber. Irises are provided at the connection between the downlink waveguides and the chamber for impedance matching purposes.

Satellite downlink signals propagate from the downlink waveguides to the feed horn through the waveguide chamber. Satellite uplink signals received by the feed horn are directed through the waveguide chamber and exit the coupler through the second cylindrical section to be sent to receiver circuitry. The dimensions of the irises and the flare angle of the tapered section are selected and optimized so that the downlink signal from the downlink waveguides is impedance matched to the waveguide chamber. The size of the second cylindrical section is selected so that the downlink modes do not propagate into the second cylindrical section.

Additional objects, features and advantages of the present invention will become apparent from the following description and appended claims taken in conjunction with the accompanying drawings.

DETAILED DESCRIPTION OF THE PREFERRED EMBODIMENTS

The following discussion of the preferred embodiments directed to an orthomode coupler for a cellular communications system is merely exemplary in nature, and is in no way intended to limit the invention or its applications or uses.

Figure 1:
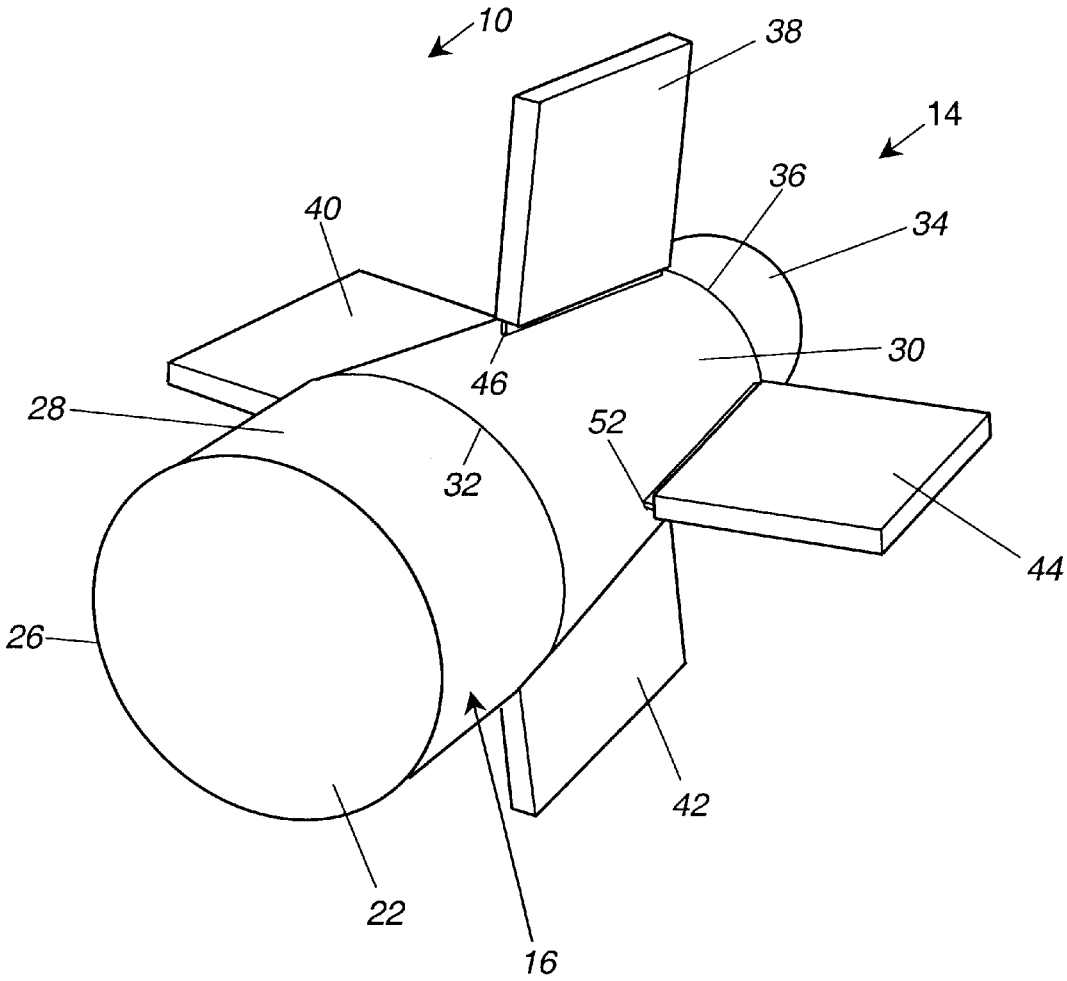
FIG. 1 is a perspective view of an orthomode coupler, according to an embodiment of the present invention.
Figure 2:
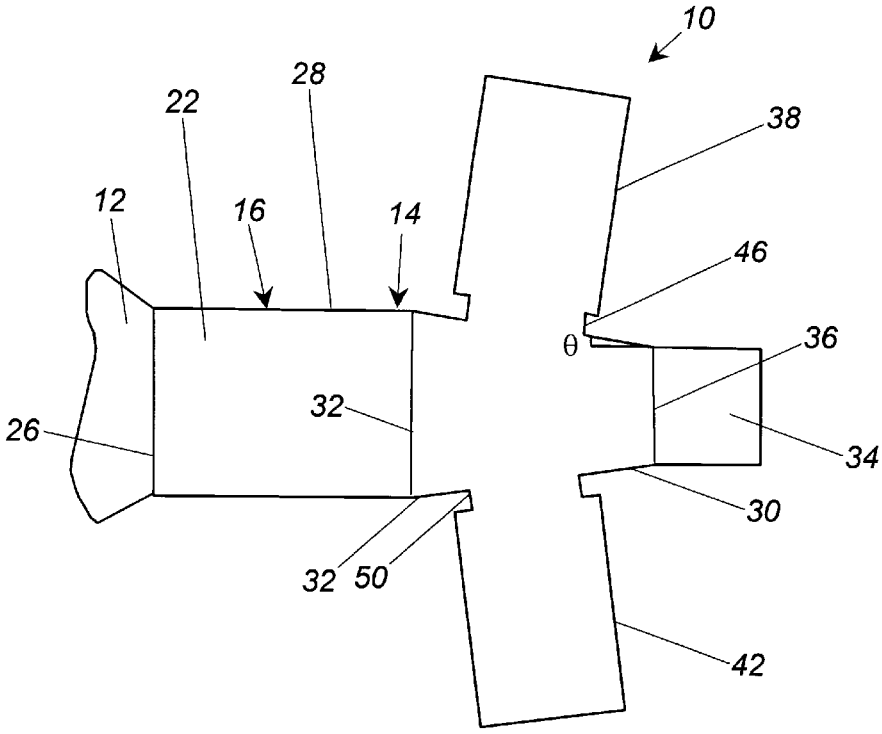
FIG. 2 is a cross-sectional view of the coupler shown in FIG. 1 in a longitudinal direction.
Figure 3:
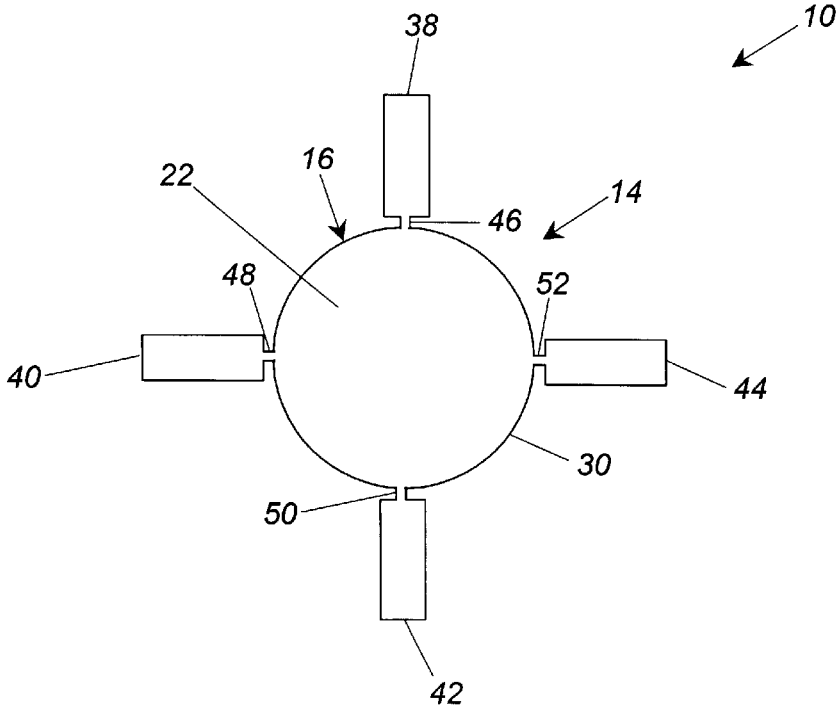
FIG. 3 is a cross-sectional view of the coupler shown in FIG. 1 in a transverse direction.

FIGS. 1–3 show various views of an orthomode coupler 10 that is part of a satellite antenna system, according to an embodiment of the present invention. As will be described below, the orthomode coupler 10 is a waveguide device that directs satellite uplink signals from an antenna feed horn 12 (only shown in FIG. 2) to receiver circuitry, and directs the satellite downlink signals from transmission circuitry to the feed horn 12. In one embodiment, the downlink signal is in the frequency range of 18.3 GHz–20.2 GHz, and the uplink signal is in the frequency range of 28–30 GHz. The dimensions of the orthomode coupler 10 would be optimized for the particular frequency bands of interest. The antenna system on the satellite would employ several feed horns and associated couplers in a particular array, and may also employ a plurality of such arrays. Additionally, each array of feed horns may include a reflector system for collecting and directing the uplink and downlink signals. The feed horn 12 can have any dimensional shape suitable for the purposes described herein.

The orthomode coupler 10 includes a waveguide structure 14 having an outer wall 16 that defines a waveguide chamber 22. The wall 16 can be made of any suitable conductive metal for the purposes described herein, such as aluminum or copper. The chamber 22 is in signal communication with the feed horn 12 at one end 26 of the structure 14. The waveguide structure 14 includes a first cylindrical section 28, a tapered conical section 30, and a second cylindrical section 34. The tapered section 30 extends from a rim 32 in the wall 16 to a rim 36 in the wall 16, and has a flare angle θ.

In this embodiment, four downlink waveguides 38–44 are symmetrically disposed around the tapered section 30. The waveguides 38–44 are in signal communication with the waveguide chamber 22 through impedance matching irises 46–52, respectively. It is important that the waveguides 38–44 be symmetrically disposed about the structure 14 for signal matching purposes. However, in alternate embodiments, a different number of waveguides can be provided, such as two waveguides, around the structure 14. In this embodiment, the waveguides 38–44 and the irises 46–52 are rectangular shaped, however, in alternate embodiments, the shape of these components may take on different configurations.

A satellite uplink signal received by the feed horn 12 is directed into the waveguide structure 14. The uplink signal is directed to a microwave network and to receiver circuitry (not shown) through the cylindrical section 34 opposite the feed horn 12. The receiver circuitry may include a polarizer and an orthomode transducer, as would be well understood to those skilled in the art. In this embodiment, the chamber 22 is free space. In alternate embodiments, it may be necessary to change the dielectric constant of the chamber 22 for signal propagation purposes by providing a suitable dielectric therein. The uplink signal that enters the chamber 22 and propagates down the waveguides 38–44 is at the uplink frequency, and thus is filtered by the transmission circuitry.

The downlink signal to be directed by the feed horn 12 enters the waveguides 38–44 from suitable transmission circuitry (not shown), that may include phase matching networks and the like, as would also be well understood to those skilled in the art. Any impedance mismatch between the waveguides 38–44 and the waveguide structure 14 results in signal loss, thus providing loss of transmission energy. According to the invention, the tapered section 30 provides signal impedance matching and coupling for the signal propagating from the waveguides 38–44 into the chamber 22. The impedance of the signal at different locations along the length of the tapered section 30 varies depending on the dimensions of the waveguide 14 at that location, thus providing the ability to use this section as an impedance matching tool. The diameter of the second cylindrical section 34 prevents the downlink signals from entering the cylindrical section 34.

The impedance matching and coupling provided by the tapered section 30 is designed in combination with the irises 46–52 to provide the desired impedance matching at the particular downlink frequency band. For example, the width and length of the irises 46–52 and the location of the irises 46–52 along the tapered section 30 are optimized for the particular frequency. Likewise, the flare angle θ and the length of the tapered section 30 is also optimized in combination with the size and position of the irises 46–52. The waveguide structure 14 is designed to transmit the lowest fundamental TE and TM modes. In one embodiment, for a downlink signal of about 30 GHz, θ is selected to be about 10°. One skilled in the art would know how to optimize these parameters for a particular frequency band.

The foregoing discussion discloses and describes merely exemplary embodiments of the present invention. One skilled in the art will readily recognize from such discussion and from the accompanying drawings and claims, that various changes, modifications and variations can be made therein without departing from the spirit and scope of the invention as defined in the following claims.

What is claimed is:

1. A signal orthomode coupler for use in a communications system, said orthomoda coupler comprising:

a waveguide structure having a first end and a second end, said first end defining a signal port of the orthomode coupler, said waveguide structure having an outer wail defining a waveguide chamber therein, said outer wall including a first cylindrical section proximate the first end, a second cylindrical section proximate the second end and a conical section therebetween so that the outer wall tapers towards the second cylindrical section; and at least one signal waveguide in signal communication with the waveguide chamber through an opening in the conical section of the outer wail, wherein the at least one waveguide includes an iris at an end of the waveguide where the waveguide is attached to the conical section, said iris having a narrower cross-section than the rest of the waveguide to provide impedance matching for the outlet signal propagating from the waveguide to the waveguide chamber, and wherein the waveguide chamber receives an inlet signal through the signal port and an outlet signal from the at least one waveguide and emits the outlet signal through the signal port.

2. The orthomode coupler according to claim 1 wherein the conical section has a flare angle of about 10 degrees.

3. The orthomode coupler according to claim 1 further comprising four waveguides equally spaced around the conical section of the outer wail, where each waveguide includes a narrow cross-section iris.

4. The orthomode coupler according to claim 1 wherein the at least one waveguide and the iris are rectangular shaped in cross-section.

5. The orthomode coupler according to claim 1 wherein the inlet signal is a satellite uplink signal and the outlet signal is a satellite downlink signal.

6. The orthomode coupler according to claim 5 wherein the first end of the orthomode coupler is attached to a feed horn.

7. An orthomode coupler for use in a satellite communications system, said orthomode coupler isolating a satellite uplink signal and a satellite downlink signal, said orthomode coupler comprising:

a waveguide structure having a first end and a second end, said first end defining a feed port of the orthomode coupler, said waveguide structure having an outer wall defining a waveguide chamber, said outer wall including a first cylindrical shaped section at the first end, a second cylindrical shaped section at the second end, and a conical shaped section therebetween, said conical section defining a predetermined flare angle; and at least one waveguide being in signal communication with the outer chamber through an opening in the conical section, wherein the at least one waveguide includes an iris at an end of the waveguide where the waveguide is attached to the conical section, said iris having a narrower cross-section than the rest of the waveguide to provide impedance matching for the outlet signal propagating from the waveguide to the waveguide chamber, and wherein the waveguide chamber receives the satellite uplink signal through the feed port and receives the satellite downlink signal from the at least one waveguide and emits the downlink signal through the feed port.

8. The orthomode coupler according to claim 7 further comprising four waveguides equally spaced around the outer wall, wherein each of the waveguides Includes an Impedance matching iris.

9. The orthomode coupler according to claim 7 wherein the first end of the orthomode coupler is attached to a feed horn.

10. The orthomode coupler according to claim 7 wherein the at least one waveguide and The iris are rectangular shaped in cross-section.

11. The orthomode coupler according to claim 7 wherein the flare angle is about 10 degrees.

12. An orthomode coupler for use in combination with a satellite antenna system, said orthomode coupler isolating a satellite uplink signal and satellite downlink signal having two different frequencies, said orthomode coupler comprising:

a waveguide structure having a first end and a second end, said first end defining a signal port of the orthomode coupler, said signal port being attached to a feed horn, said waveguide structure having an outer wall defining a waveguide chamber, said outer wall including a first cylindrical shaped section at the first end, a second cylindrical shaped section at the second end, and a conical section therebetween, said conical section defining a predetermined flare angle; and four rectangular waveguides being in signal communication with the waveguide chamber through openings in the conical section, said waveguides being equally spaced around the conical section, each of the waveguides including an iris at an end of the waveguide where the waveguide is attached to the outer wall, said iris having a narrower cross-section than the rest of the waveguide to provide impedance matching for the outlet signal propagating from the waveguides to the waveguide chamber, wherein the waveguide chamber receives the uplink signal through the signal port and receives the downlink signal from the waveguides and emits the downlink signal through the signal port.

13. The orthomode coupler according to claim 12 wherein the flare angle is about 10 degrees.

14. The orthomode coupler according to claim 12 wherein each waveguide and iris is rectangular shaped in cross-section.

* * * * *